United States Patent [19]

Bruehl et al.

[11] Patent Number: 4,895,240

[45] Date of Patent: Jan. 23, 1990

[54] COGBELT HANDRAIL DRIVE FOR PASSENGER CONVEYOR

[75] Inventors: Klaus Bruehl, Hanover; Dietmar Thaler, Seggebruch, both of Fed. Rep. of Germany

[73] Assignee: Otis Elevator Company, Farmington, Conn.

[21] Appl. No.: 324,079

[22] Filed: Mar. 16, 1989

[51] Int. Cl.[4] ..... B66B 21/00

[52] U.S. Cl. ..... 198/331; 198/335

[58] Field of Search ..... 198/330, 331, 335, 835

[56] References Cited

U.S. PATENT DOCUMENTS

| | | | |
|---|---|---|---|
| 3,653,484 | 4/1972 | Taylor | 198/335 |
| 3,779,360 | 12/1973 | Taher et al. | 198/335 |
| 4,134,883 | 1/1979 | Mendelsohn et al. | 198/335 X |
| 4,200,177 | 4/1980 | Sato et al. | 198/335 |
| 4,535,880 | 8/1985 | Boltrek | 198/331 X |

FOREIGN PATENT DOCUMENTS

| | | | |
|---|---|---|---|
| 1506480 | 10/1969 | Fed. Rep. of Germany | 198/331 |
| 2252763 | 5/1974 | Fed. Rep. of Germany | 198/330 |
| 0918176 | 2/1963 | United Kingdom | 198/331 |
| 1086930 | 10/1967 | United Kingdom | 198/330 |
| 2047646 | 12/1980 | United Kingdom | 198/331 |

*Primary Examiner*—Robert J. Spar
*Assistant Examiner*—James R. Bidwell
*Attorney, Agent, or Firm*—William W. Jones

[57] ABSTRACT

The handrail of an escalator of other passenger conveyor is driven by traction rollers which engage the handrail and also directly engage links which are connected to and drive the steps or tread of the conveyor. The handrail is biased into engagement with the traction rollers, and moves at substantially precisely the same speed as the steps or tread due to the direct connection between the step or tread drive and the handrail drive.

6 Claims, 1 Drawing Sheet

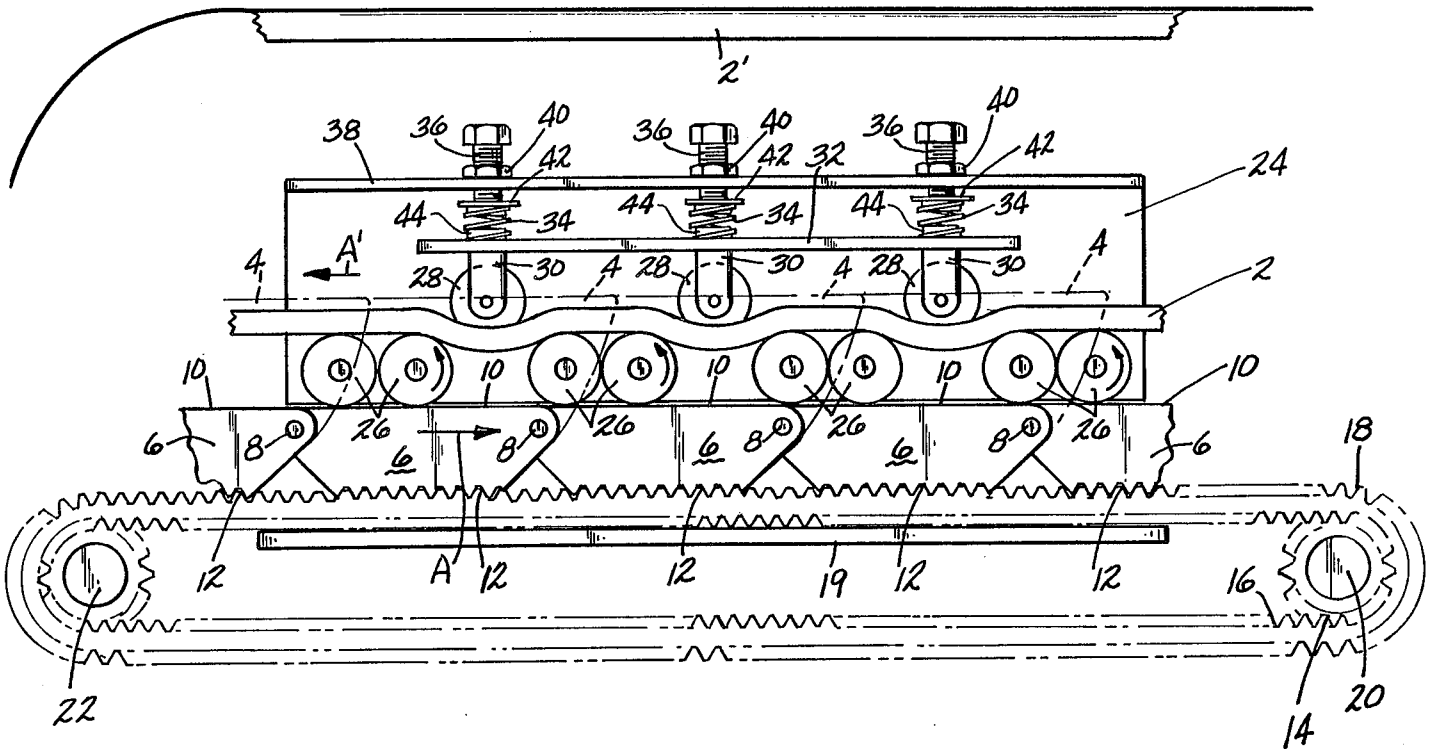
2'
24
2
10
6
18
20
14
16
12
26
8
4
40
42
34
30
36
44
28
32
38
A'
A
22

COGBELT HANDRAIL DRIVE FOR PASSENGER CONVEYOR

DESCRIPTION

1. Technical Field

This invention relates to an escalator handrail drive assembly, and more particularly to a drive assembly which uses cogs mounted on the escalator steps to drive the handrail. The cog step drive assembly is disclosed in copending U. S. Application Ser. No. 281,606 filed Dec. 9, 1988.

2. Background Art

Escalator handrails, as well as moving walkway handrails, are driven in synchronism with the treads on which the passengers stand. The handrail typically takes the form of an endless belt which is moved over a handrail guide mounted on a balustrade, and which loops into a reentry housing at the exit end of the conveyor. The handrail is engaged by drive rollers or the like along its return path beneath the escalator or moving walkway, and is thus powered over its path of travel. The handrail drive mechanism will typically be driven by an endless chain entrained on sprockets mounted on one or more of the drive rollers, and the endless chain will, in turn, be driven by an auxiliary chain powered by the same motor that drives the treads. Thus, the prior art handrail driving mechanisms require a driven set of rollers which engage the handrail, plus an auxiliary chain loop which interconnects the drive rollers with the motor that powers the treads. This type of mechanism is complex and takes up much space in a housing or envelope that should be kept as compact as possible.

DISCLOSURE OF THE INVENTION

This invention relates to a handrail drive for an escalator or similar passenger conveyor wherein the handrail is moved in substantially exact coincidence with the treads. The treads are driven by a series of toothed cogs, one of which is journaled to the step axle of each of the escalator steps. The cogs are pivotally connected together so as to be movable along the path of travel of the steps, beneath the steps. The side of the cogs remote from the steps has a toothed, or rack, surface and is engaged by a powered endless toothed belt which is driven by an electric motor to supply the motive power for the escalator. The opposite surface of the cogs is smooth and relatively planar and supplies the motive power for moving the handrail. Adjacent to the smooth surface of the cogs is a series of traction rollers which are rotated about their axes through contact with the smooth surface of the cogs which pass beneath the traction rollers. A series of biased pressure rollers is disposed above the traction rollers. The handrail on its return path passes between the traction rollers and the pressure rollers, whereby the latter serve to bias the handrail against the traction rollers. Since the traction rollers are driven directly by the cogs, the handrail will be driven at substantially the same speed as the steps, and thus will move synchronously with the steps.

It is therefore an object of this invention to provide a simplified escalator handrail drive mechanism whereby the handrail and the steps of the escalator will be driven in synchronism.

It is a further object of this invention to provide a mechanism of the character described wherein an intermediate chain and sprocket assembly is not needed to interconnect the handrail roller drive and the escalator step drive assemblies.

It is an additional object of this invention to provide a mechanism of the character described wherein the handrail is driven directly by the same assembly that drives the steps.

These and other objects and advantages of the invention will become more readily apparent from the following detailed description of a preferred embodiment thereof when taken in conjunction with the accompanying drawing.

BRIEF DESCRIPTION OF THE DRAWING

The sole figure is a fragmented side elevational view of a first embodiment of a handrail drive formed in accordance with this invention.

Referring now to the drawing, there is shown an embodiment of a handrail drive constructed in accordance with this invention. The handrail is identified generally by the numeral 2 in the drawing. The steps 4 (shown in phantom) which provide a moving tread for passengers are driven along their path of movement by cog links 6 which are pivotally connected to the step axles 8 of the steps 4. As shown in the drawing, the steps 4 and cog links 6 are moving in the direction of the arrow A. Each cog link 6 is formed with a smooth planar upper traction surface 10 and a toothed lower surface 12. The lower surfaces 12 of the cog links 6 mesh with a double-sided toothed belt 14, which has an outer toothed surface 16 and an inner toothed surface 18. The belt 14 is driven by sprockets 20 and 22, one or both of which are rotated by an electric motor (not shown). A pressure plate 19 may be mounted on the truss beneath the belt 18 to keep the latter from sagging thereby ensuring proper positioning of the cog links. A handrail drive roller mounting bracket 24 is mounted on the escalator truss above the cog links 6. A plurality of traction rollers 26 are journaled on the bracket 24. The traction rollers 26 engage the traction surfaces 10 of the cogs 6. The traction rollers 26 are thus rotated in the counterclockwise direction by the movement of cog links 6. A plurality of contact rollers 28 are mounted above the handrail 2 on forks 30. A floating pressure plate 32 engages all of the forks 30 and is biased toward the handrail 2 and traction rollers 26 by springs 34. The springs 34 are mounted between the upper spring guides 42 and lower spring guides 44 provided with fixed reaction surfaces for the springs 34. The lower spring guides 44 are fixed to a floating pressure plate 32 which is movable, but fixed against horizontal movement to the bracked 24. The movable upper spring guides 42 are fixed on the pressure screws 36 which are secured to a flange 38 against vertical movement by nuts 40. With the pressure screws 36 the spring force of springs 34 is adjustable The contact rollers 38 thus bias the handrail 2 against the traction rollers 26, which thus drive the handrail in the direction of the arrow A'. The net result is that the exposed portion of the handrail 2' will be driven in the same direction as the steps 4 and at the same speed since the same members, i.e., the cog links 6 provide the motive force for both the steps 4 and the handrail 2.

Since the cog links directly transmit motion to the handrail through the traction rollers, which only reverse the direction of movement of the cog links, it will be appreciated that an exact coincidence of step and handrail movement is provided. The tensile force on the handrail is adjustable by virtue of the movable contact rollers which run over the inside of the handrail. The traction rollers will preferably be laminated with an elastomer or comparable material to avoid slippage between the traction rollers and handrail.

Since many changes and variations of the disclosed embodiment of the invention may be made without departing from the inventive concept, it is not intended to limit the invention otherwise that as required by the appended claims.

What is claimed is:

1. A passenger conveyor assembly of the type having a moving tread and a moving handrail and including a handrail drive comprising:

a) a plurality of driven links connected to said tread to drive the latter along its path of travel, said links including smooth planar traction surfaces thereon; and b) a plurality of traction rollers mounted adjacent to said traction surfaces, said traction rollers being rotated about their axes by said link traction surfaces, and said traction rollers contacting said handrail to drive the latter along its path of travel at the same rate of movement as said tread.

2. The assembly of claim 1, further comprising a plurality of contact rollers engaging said handrail to bias the latter against said traction rollers.

3. The assembly of claim 2, further comprising means for supporting said links as they move for ensuring proper positioning of said links for driving contact with said traction rollers.

4. The assembly of claim 3, wherein said links have a toothed surface opposite said traction surface, and further comprising a powered toothed belt meshing with said link toothed surfaces to drive said links.

5. A passenger conveyor assembly comprising:

a) a plurality of steps forming a moving tread for supporting passengers thereon;

b) a moving handrail;

c) a plurality of links connected to step axles on said steps, each of said links having a relatively smooth planar traction surface thereon;

d) a plurality of traction rollers rotatably journaled adjacent to said links, said traction rollers contacting said traction surfaces on said links, and said traction rollers contacting said handrail;

e) a plurality of contact rollers movably mounted adjacent to said handrail, said contact rollers biasing said handrail against said traction rollers; and f) means for moving said links to drive said steps and handrail along their respective paths of travel.

6. The assembly of claim 5, further comprising support means operable to properly position said links to ensure even contact between said traction surfaces and said traction rollers.

* * * * *